US008354003B2

(12) United States Patent
Virtanen

(10) Patent No.: US 8,354,003 B2
(45) Date of Patent: Jan. 15, 2013

(54) REINFORCED POROUS FIBRE PRODUCT

(75) Inventor: Pentti Virtanen, Valkeakoski (FI)

(73) Assignee: Nordkalk Oy Ab, Pargas (FI)

( * ) Notice: Subject to any disclaimer, the term of this patent is extended or adjusted under 35 U.S.C. 154(b) by 0 days.

(21) Appl. No.: 12/922,466

(22) PCT Filed: Feb. 20, 2009

(86) PCT No.: PCT/FI2009/050141

§ 371 (c)(1),
(2), (4) Date: Nov. 29, 2010

(87) PCT Pub. No.: WO2009/112635

PCT Pub. Date: Sep. 17, 2009

(65) Prior Publication Data

US 2011/0061827 A1 Mar. 17, 2011

(30) Foreign Application Priority Data

Mar. 14, 2008 (FI) ..... 20085227

(51) Int. Cl.
*D21F 11/00* (2006.01)

(52) U.S. Cl. ..... 162/158; 162/181.1; 162/181.3; 162/181.6

(58) Field of Classification Search ..... 162/158, 162/181.1, 181.6; 106/286.5, 287.34, 287.17, 106/287.24, 287.23; 428/402, 402.21, 402.22, 428/24, 332, 338
See application file for complete search history.

(56) References Cited

U.S. PATENT DOCUMENTS

| | | | | |
|---|---|---|---|---|
| 4,346,178 | A | 8/1982 | Economou | |
| 4,388,150 | A * | 6/1983 | Sunden et al. | 162/175 |
| 4,755,259 | A * | 7/1988 | Larsson | 162/178 |
| 4,816,074 | A | 3/1989 | Raythatha et al. | |
| 4,826,536 | A * | 5/1989 | Raythatha et al. | 106/465 |
| 4,851,048 | A | 7/1989 | Jones et al. | |
| 4,902,382 | A * | 2/1990 | Sakabe et al. | 162/175 |
| 4,961,825 | A * | 10/1990 | Andersson et al. | 162/175 |
| 5,011,534 | A | 4/1991 | Berube et al. | |
| 5,122,191 | A | 6/1992 | Morozumi et al. | |
| 5,203,918 | A * | 4/1993 | Rice | 106/486 |
| 5,336,311 | A * | 8/1994 | Curtis et al. | 106/416 |
| 5,584,925 | A | 12/1996 | Maxwell et al. | |
| 5,626,665 | A | 5/1997 | Barger et al. | |
| 5,788,762 | A | 8/1998 | Barger et al. | |
| 5,958,131 | A | 9/1999 | Asbridge et al. | |
| 5,976,241 | A | 11/1999 | Kim et al. | |
| 6,027,561 | A | 2/2000 | Gruber et al. | |
| 6,074,530 | A * | 6/2000 | Tillirson | 162/181.6 |
| 6,149,723 | A * | 11/2000 | Pruett et al. | 106/486 |
| 6,494,991 | B1 | 12/2002 | Palmer et al. | |
| 7,611,575 | B2 * | 11/2009 | Sare et al. | 106/678 |
| 8,034,847 | B2 * | 10/2011 | Mohan et al. | 521/56 |
| 2005/0155732 | A1 * | 7/2005 | Capwell | 162/158 |
| 2006/0157212 | A1 | 7/2006 | Berube et al. | |
| 2006/0289135 | A1 | 12/2006 | Grant et al. | |

FOREIGN PATENT DOCUMENTS

| | | | |
|---|---|---|---|
| EP | 0892019 | A1 | 1/1999 |
| FI | 115046 | B1 | 2/2005 |
| WO | 9419413 | | 9/1994 |
| WO | 2005052256 | A2 | 6/2005 |
| WO | 2005108295 | A1 | 11/2005 |
| WO | 2006085060 | A2 | 8/2006 |

OTHER PUBLICATIONS

International Search Report and Written Opinion from corresponding International Application No. PCT/FI2009/050141, dated Aug. 3, 2009 (12 pages).

* cited by examiner

*Primary Examiner* — Mark Halpern
(74) *Attorney, Agent, or Firm* — McCormick, Paulding & Huber LLP

(57) ABSTRACT

The present invention relates to a porous fiber product, which contains chemical pulp or wood fibers, between which structural filler particles are attached, as well as to a method of manufacturing this product, wherein filler drops are produced in a spray dryer from the aqueous solution of the filler, the drops forming filler particles when the water evaporates, the particles being attached to the chemical pulp or wood fibers.

17 Claims, 16 Drawing Sheets

REINFORCED POROUS FIBRE PRODUCT

CROSS REFERENCE TO RELATED APPLICATIONS

This application is entitled to the benefit of and incorporates by reference essential subject matter disclosed in International Patent Application No. PCT/FI2009/050141 filed on Feb. 20, 2009 and Finnish Patent Application No. 20085227 filed Mar. 14, 2008.

FIELD OF THE INVENTION

The present invention relates to a porous fibre product that contains chemical pulp fibres or wood fibres and filler particles, and to a method of manufacturing such a product. In particular, the invention relates to the manufacture of sack paper, fibre-bearing bags, wrappers, filter materials and porous printing paper.

BACKGROUND OF THE INVENTION

Traditionally, porous sack paper or paper for manufacturing carrier bags has been manufactured without filling agents. Strength properties are especially important, particularly in the case of sack paper, and fillers weaken the strength. On the other hand, using fillers would include the advantage of being able to reduce the amount of expensive chemical pulp fibre, while providing improved printability and runnability of a board machine, as the filler does not absorb as much water as the chemical pulp fibre. Typically, the strength of sack paper is achieved by refining the paper pulp, using chemical pulp fibres and by a suitable fibre orientation at the wire section. It is necessary for a sack made of sack paper to have porosity, so that air can quickly be removed from inside the sack when filling the same. If air is not quickly removed, the filling of the sack is considerably decelerated. Generally, the sacks are made of several sack papers, but it may also be necessary for a single-layer kraft paper to have porosity.

The porosity of a packaging material is mostly measured in Gurley values or, alternatively, by a Bendtsen apparatus. Gurley can be used to measure how long it takes for 100 $cm^3$ of air to flow through a sample area of one square inch under a pressure of 1.22 kPa. Typically, the Gurley value of a highly-porous sack paper should be less than 10 seconds and, in some cases, as low as 5 seconds. Generally speaking, it is quite difficult to achieve the desired Gurley values that are required of sack paper, single-layer kraft paper or paper, which bags are made of.

Typically, the porosity is provided by a suitable selection and refining of fibre pulp. However, this calls for a decrease in the productivity of the machine, as more time is required for refining in the process and the energy consumption increases. Enhancing the refining of pulp also decelerates the removal of water at the wire section, which means that the paper web conveyed to the press section contains more moisture. The porosity can also be provided by specific chemicals, such as retention agents.

In some cases, the porosity required is provided by making a required number of pinholes in the finished sack paper before filling the sack. In that case, the pinholes are made mechanically in the sack. However, the mechanical treatment may damage the sack paper. Furthermore, this also requires extra processing time and energy expenses.

As stated above, a typical way of providing the required porosity of the sack paper is high-density refining. Due to the tearing strength, in particular, the fibre orientation is an essential matter, which should be taken into account at the wire section. Generally, starch is used to increase the strength of paper. In that case, starch is dosed into high-consistency pulp.

In the paper making process, there is a need to combine porosity, strength, printability, quicker water removal at the wire section and the replacement of the more expensive chemical pulp fibre with cheaper materials, such as filler agglomerates. Furthermore, it would be preferable to be able to reach the high porosity level without mechanically perforating the material.

SUMMARY OF THE INVENTION

An object of the present invention is to provide a porous fibre product which, in spite of the filler contained in it, maintains its high strength properties.

Surprisingly, it has been observed that by using filler particles, such as agglomerates, the decrease in strength can be considerably prevented compared to the use of the conventional filler without agglomeration.

The present invention thus relates to a porous fibre product that contains chemical pulp or wood fibres.

To be more precise, the product according to the present invention is characterized in that structural filler particles are attached between the fibres, and in that, both between the fibres and between the fibres and the particles, there is a material made of silicon dioxide, alum or aldehyde or a mixture thereof that functions as a binder.

The method according to the invention is characterized in adding an acidic chemical, which preferably is an acid, aluminium sulphate or another chemical having a sulphate group, to the aqueous solution after adding the binder, and the use of the product according to the invention is characterized in forming an aqueous solution of the filler; producing filler drops from the aqueous solution in a spray dryer, whereby also excess water evaporates out and filler particles are formed; adding a binder made of silicon dioxide, alum or aldehyde to the aqueous solution of the filler under mixing; and attaching the formed filler particles in a sintered or ductile form to the chemical pulp or wood fibres in the aqueous dispersion thereof.

The present invention provides a fibre product, preferably a paper or cardboard product, more preferably a sack paper product, which is porous and has a high strength level and improved stiffness compared to products that are manufactured by the known methods. In particular, the product provided by the present invention has good printability and coatability, high strength, a good moisture profile and thickness, especially in a sack machine, a good T.E.A. value (tensile energy absorption) and tear strength, high stiffness and porosity. The sack paper product according to the present invention can be manufactured by using one layer instead of the conventional four layers. In other words, regarding the porosity, a technically improved sack product can be achieved, which is more profitable than the corresponding known products and which is made porous without mechanical perforation.

BRIEF DESCRIPTION OF THE DRAWINGS

The other details and advantages of the invention are disclosed in the following detailed description.

FIGS. 3A and 3B of the tensile strength of the papers, FIGS. 3C and 3D of their tear strength, FIGS. 3E and 3F of their tensile energy absorption value, FIGS. 3G and 3H of the elongation, FIG. 31 of the porosity, FIG. 3J of the Gurley value of the papers and FIG. 3K of the stiffness of the papers;

DETAILED DESCRIPTION OF THE PREFERRED EMBODIMENTS

The present invention relates to a porous fibre product that contains chemical pulp or wood fibres, wherein structural filler particles are attached between the fibres. These particles both enhance the porosity of the product and bind the fibres to each other, whereby the strength remains unchanged or is even improved compared to the original fibre product that contains no filler.

Figure 4A:
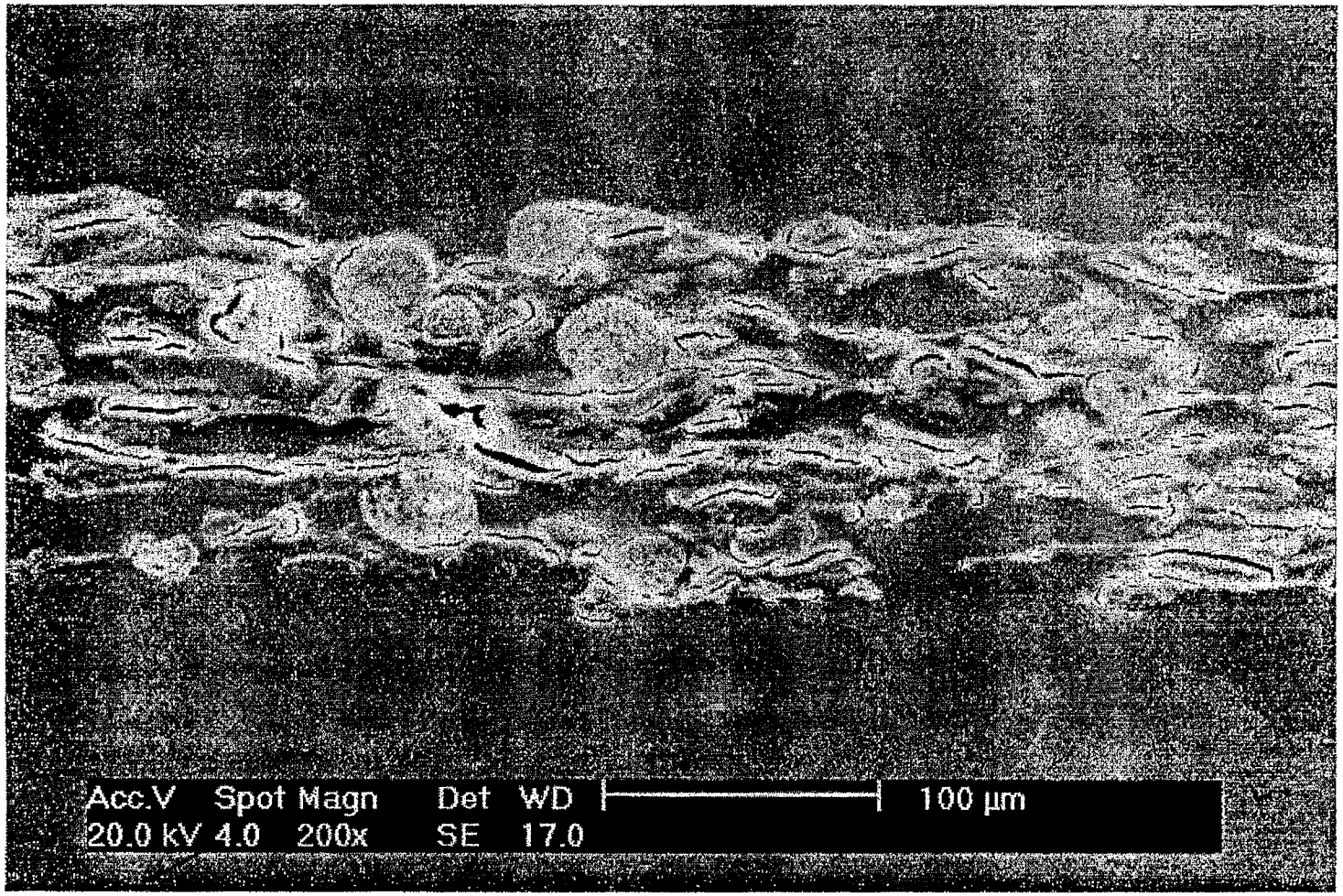
FIGS. 4A and 4B show electron microscope images of the fibre product according to the invention; a 200-fold enlargement in FIG. 4A and a 1000-fold enlargement in FIG. 4B.
Figure 4B:
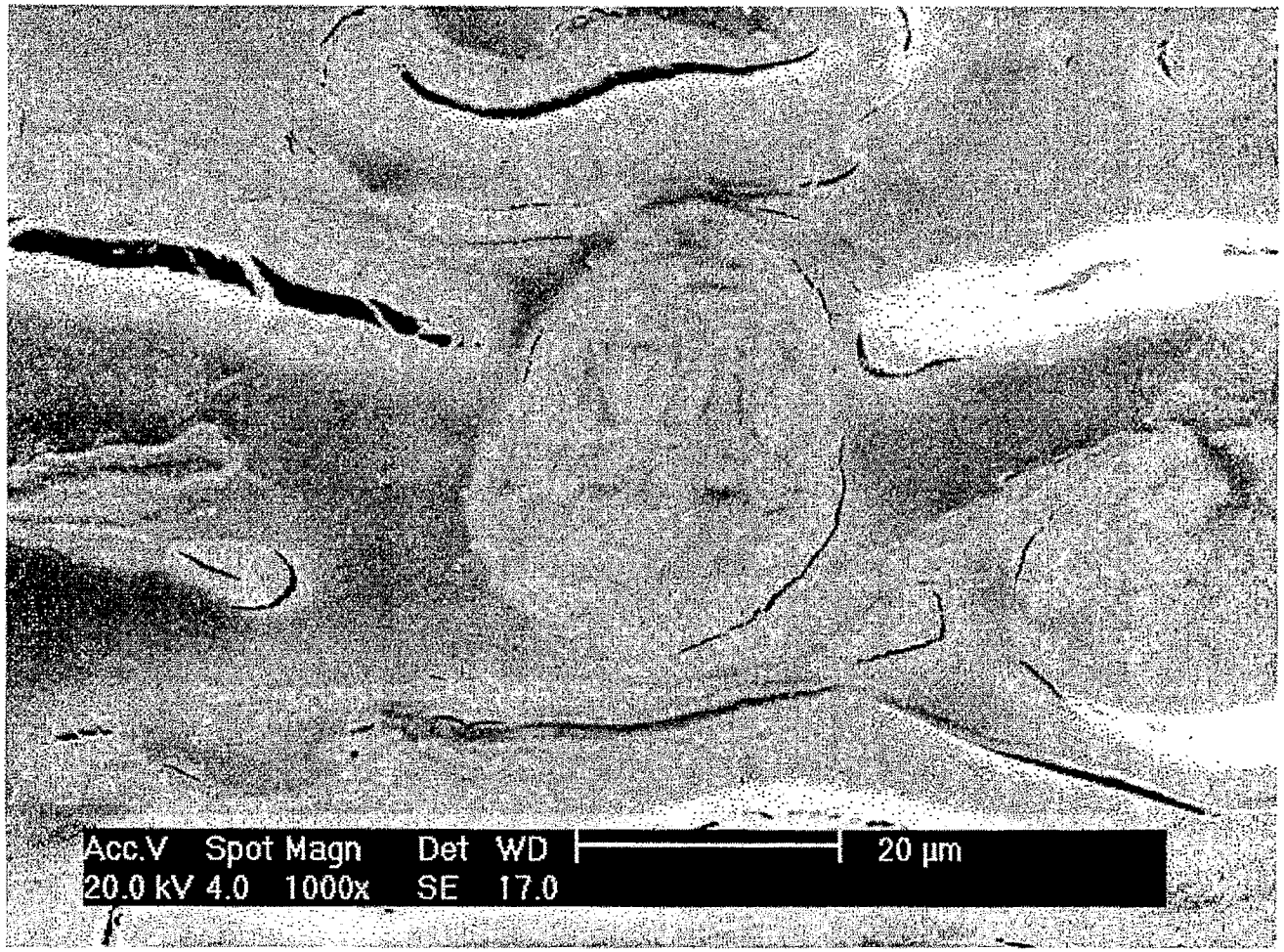

The fibre product preferably consists of paper or cardboard, more preferably kraft paper, particularly sack paper (the microscopic image in FIG. 4), single-layer kraft paper or filter paper. The fibres employed preferably either comprise chemical pulp, which is manufactured by the sulphate method, contains lignin and is particularly suitable, for example, for manufacturing kraft paper, or mechanical pulp fibres, refiner mechanical pulp fibres or chemi-mechanical refiner pulp fibres.

According to a preferred embodiment, the porosity of the fibre product is below 10 seconds/100 ml, measured as a Gurley value. However, according to the invention, highly-porous products with a Gurley value of as low as below 5 seconds/100 ml can be achieved.

Various mineral fillers, preferably metakaolin, can be used as fillers in the particles.

Figure 1:
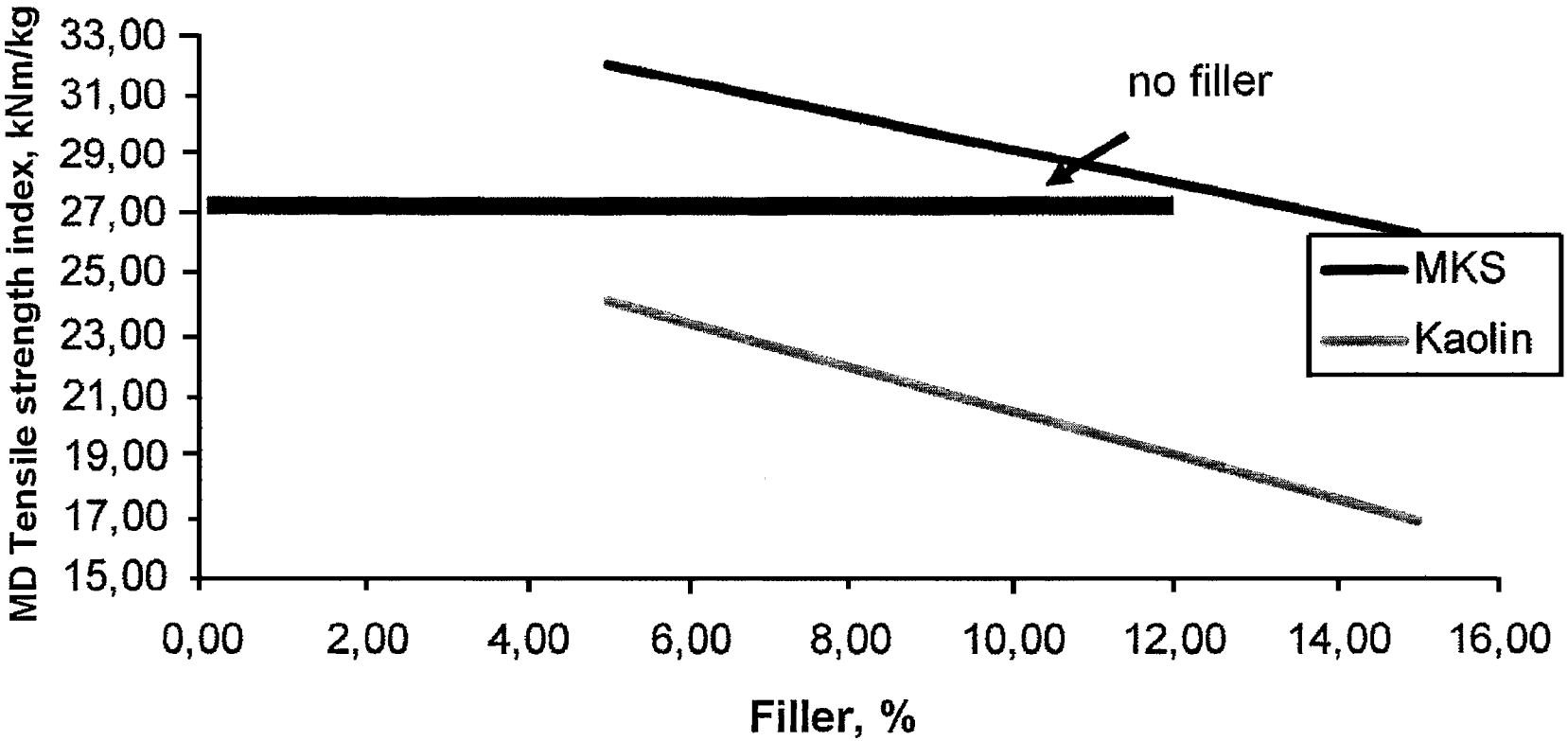
FIG. 1 shows a graphical comparison of the tensile strength index of three different sack papers, one of the papers using no filler, the second one using kaolin as filler and the third one using metakaolin particles, according to the invention.

"Filler particles" in this context refer to agglomerate, sinter or granule particles that contain fillers. They preferably contain metakaolin and they can be called "metakaolin sinter" (MKS). Regardless of using the filler particles, the end product according to the invention, i.e., the porous end product keeps its good strength level (FIGS. 1, 2 and 3).

The use of metakaolin as an additive to cement is well-known. The U.S. Pat. No. 6,027,561, among others, describes a composition that contains cement and metakaolin. It is made by heat-treating kaolin, elutriating it in water and drying the slurry by spray drying, whereby agglomerated beads are formed, their diameter being at least 10 microns.

Other patents that use metakaolin as an additive to cement include U.S. Pat. Nos. 5,976,241, 5,958,131, 5,626,665, 5,122,191 and 5,788,762.

In the present invention, the manufacture of the particles of fillers or pigments, such as agglomerates, can be carried out, among others, by means of chemicals or heating or mixing or a combination thereof, preferably by means of spray drying and the heat produced thereby, and a binder.

The use of the binder further improves the strength level of the filler particles. Among others, a silicate that has a colloidal size can be used as binder. When selecting silicates, it is essential that something in the dimensions of the silicate is in the colloidal range, i.e. 1 μm-1 nm. The silicate of a colloidal size can comprise, among others, a colloidal silicate, silicate micro gel or structured silicate. The colloidal size silicate can also contain iron, aluminium, magnesium or manganese ions.

If the colloidal size silicate is mixed with the aqueous solution of the filler, the following improvements in the end product are observed, compared to using filler particles only:

1 the strength level increases 2 the stiffness improves 3 the high porosity is maintained.

Surprisingly, it is also observed that if the colloidal size silicate is added to the aqueous solution of the filler, while mixing and adding an acidic chemical, the following advantageous changes are provided:

1 the strength level further increases 2 the stiffness further improves 3 a high porosity level is achieved.

The acidic chemical may be an acid, aluminium sulphate or another chemical that has a sulphate group.

The use of aldehyde and alum in the aqueous solution of the filler instead of or in addition to silicon dioxide also improves the strength properties of the product.

The attachment of the filler particles, preferably metakaolin particles, to the chemical pulp fibres or wood fibres is implemented, while the particles are preferably in a sintered or ductile form, most suitably in the sintered form, by using the above-mentioned binders, which preferably comprise silicon dioxide, alum or aldehyde, most suitably silicon dioxide or alum. The aldehyde is preferably glyoxal. The amount of silicon dioxide used is preferably 0.5-20% by weight, more preferably 0.5-5% by weight, most preferably 1-3% by weight. The amount of alum used, in turn, is preferably 0.5-10% by weight, more preferably 0.5-3% by weight. Correspondingly, the amount of glyoxal used is preferably 0.5-20% by weight, more preferably 0.5-5% by weight.

The attachment is successful, because the fibrils of the chemical pulp or wood fibres are ampholytic, i.e., they function both as acids and alkalis. At their ends, there are plenty of negatively charged $OH^-$ groups, which are formed when the fibres are dispersed in water, i.e., the fibrils are polar. Together with polar water molecules, these polar fibrils thus form a barrier to the flow of water. The metakaolin particles break the hydrogen bonds formed by water and the $OH^-$ groups in the fibres, whereby a more open pore structure and a product that is easier to dry are generated. After incorporating the particles into this pore structure, the binders, such as silicon dioxide, alum and glyoxal, attach the chemical pulp or wood fibres tightly to each other, forming a stiff paper web and, at the same time, these binders attach the filler particles to the fibres. In this way, a fibre product is achieved, the porosity of which is sufficient for filling the requirements of sack paper, among others.

When using silicon dioxide in the attachment, the forming of new hydrogen bonds is at least partly utilized:

$$—H—SiO_2—O—$$

As mentioned above, due to their ampholytic aspect, the chemical pulp or wood fibres function both as acids and alkalis. Therefore, both silicon dioxide and alum can be used as binders, even though they function in different pH ranges. Silicon dioxide produces a bond from the acidic side of the fibre fibrils, whereas alum produces a bond from the alkaline side.

The silicon dioxide used is preferably silicon dioxide micro gel or silicon dioxide sol. The micro gel is formed from amorphous particles and silicic acid. It functions in a pH range of <12, preferably about 2. Correspondingly, the alum used, i.e., $Al(SO_4)_3.14\text{-}18H_2O$, functions in a pH range of <7. They can also be used together.

As an alternative manufacturing method in the present invention, the manufacture of a product described in the previous patent FI 1115046 can be used, wherein spherical porous agglomerates are manufactured, which at least partly consist of metakaolin particles, whereby the size of single porous agglomerates is 2-500, more preferably 20-40 microns, and the density of their surface parts is lower than that of the inner parts. The pore structure in the surface and inner parts is essentially the same. According to the method, kaolin agglomerates are first formed from the kaolin, their average particle size being about 2-100 micrometers, and these agglomerates are thereafter calcined into metakaolin, whereby agglomerates are obtained, which have an open pore structure, the density of their surface part being lower than that of the inner part and their pore structure in the surface and inner parts being the same.

Typically, a particularly preferable size of the MKS particles used in the invention is 20-40 microns and they have an essentially spherical form. By using spray drying in the manufacture of the particles, particles with a size of 10-40 microns can be achieved.

The following, non-limiting examples illustrate the invention and its advantages.

EXAMPLES

The metakaolin agglomerates used in the following examples are manufactured using bicarbonate and heating, which is achieved as a result of spray drying and partial calcination. The best results are achieved by adding to the aqueous solution of the filler agglomerate about 3% by weight of inorganic silicon dioxide or about 1% by weight of alum, calculated from the weight of the filler agglomerates. Almost equally good results are achieved by adding about 5% by weight of glyoxal.

Example 1

Sack paper pulp (UPM Kymmene) was used, its consistency being 4.3% and its SR number being 10 in the first test series, and 15 in the second and third test series. To this viscous pulp, the following components in a dry form were added (in the order mentioned), mixing for 60 seconds after each addition:

10 kg/tonne of starch (Raisamyl 70021)

2.5 kg of resin adhesive (Raisize K35 AS)

8 kg/tonne of alum

Sack paper sheets were manufactured in a dynamic sheet former (DSF) after having added to the pulp another 200 g/tonne of polyacrylamide (P3320) before the screen. The desired basis weight of the sheets was 100 g/m$^2$.

The analysis results are shown in Table 1 below, which compares the results of a paper not containing the filler (the Control), a paper containing kaolin (Capim DG) as filler and a paper containing the filler particles (MKS) that are used according to the invention. The results are compared in FIG. 1, respectively.

TABLE 1

| | MD Tensile strength kNm/kg | CD Tensile strength kNm/kg | MD Tear strength mN | CD Tear strength mN | MD Elongation % | CD Elongation % | Porosity μm/Pas | MD Stiffness mNm | MD T.E.A. J/m$^2$ | CD T.E.A. J/m$^2$ | Gurley s/100 ml |
|---|---|---|---|---|---|---|---|---|---|---|---|
| Control | 27.4 | 101.5 | 1652.5 | 2435.4 | 5.7 | 3.7 | 21.2 | 2.2 | 115.9 | 237.1 | 12.5 |
| 5% MKS | 32.1 | 100.4 | 1335.8 | 2394.6 | 5.0 | 3.5 | 21.6 | 1.7 | 114.6 | 231.5 | 4.6 |
| 5% Capim | 24.2 | 77.3 | 1253.2 | 1987.3 | 4.1 | 3.0 | 18.0 | 1.8 | 73.8 | 155.2 | 12.9 |
| 10% MKS | 29.3 | 88.6 | 1258.1 | 2258.8 | 5.0 | 3.6 | 48.4 | 1.7 | 104.4 | 207.3 | 3.6 |
| 10% Capim | 20.6 | 64.5 | 1056.2 | 1693.6 | 3.5 | 2.6 | 13.6 | 1.4 | 55.2 | 117.4 | 21.7 |
| 15% MKS | 26.4 | 76.8 | 1059.1 | 2048.4 | 5.0 | 3.6 | 75.2 | 1.6 | 94.2 | 183.1 | 2.7 |
| 15% Capim | 16.9 | 51.7 | 936.3 | 1484.5 | 2.9 | 2.2 | 9.3 | 1.0 | 36.7 | 79.6 | 30.5 |

Example 2

Figure 2A:
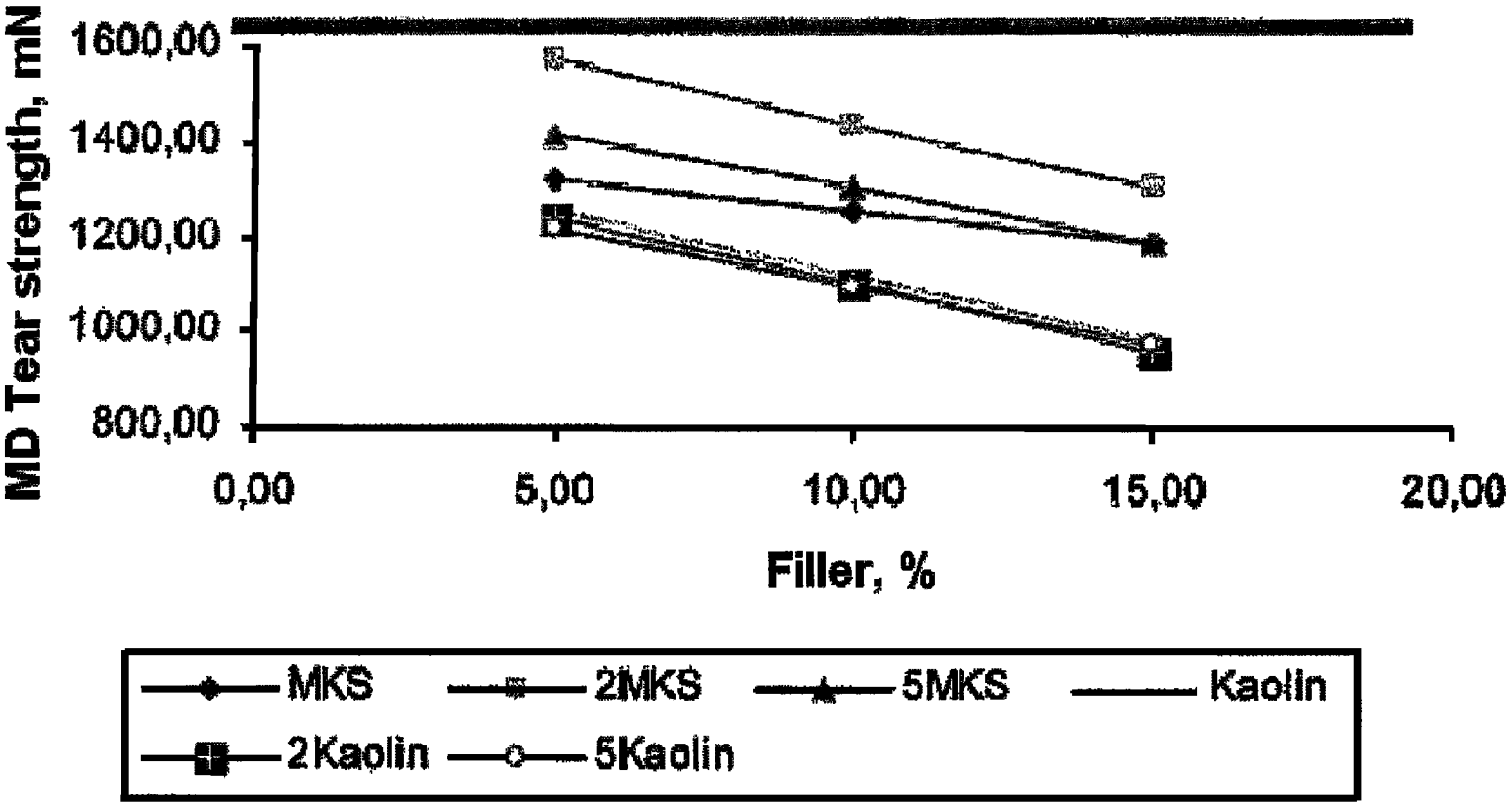
FIGS. 2A and 2B show graphical comparisons of the tear strength of different sack papers.
Figure 2B:
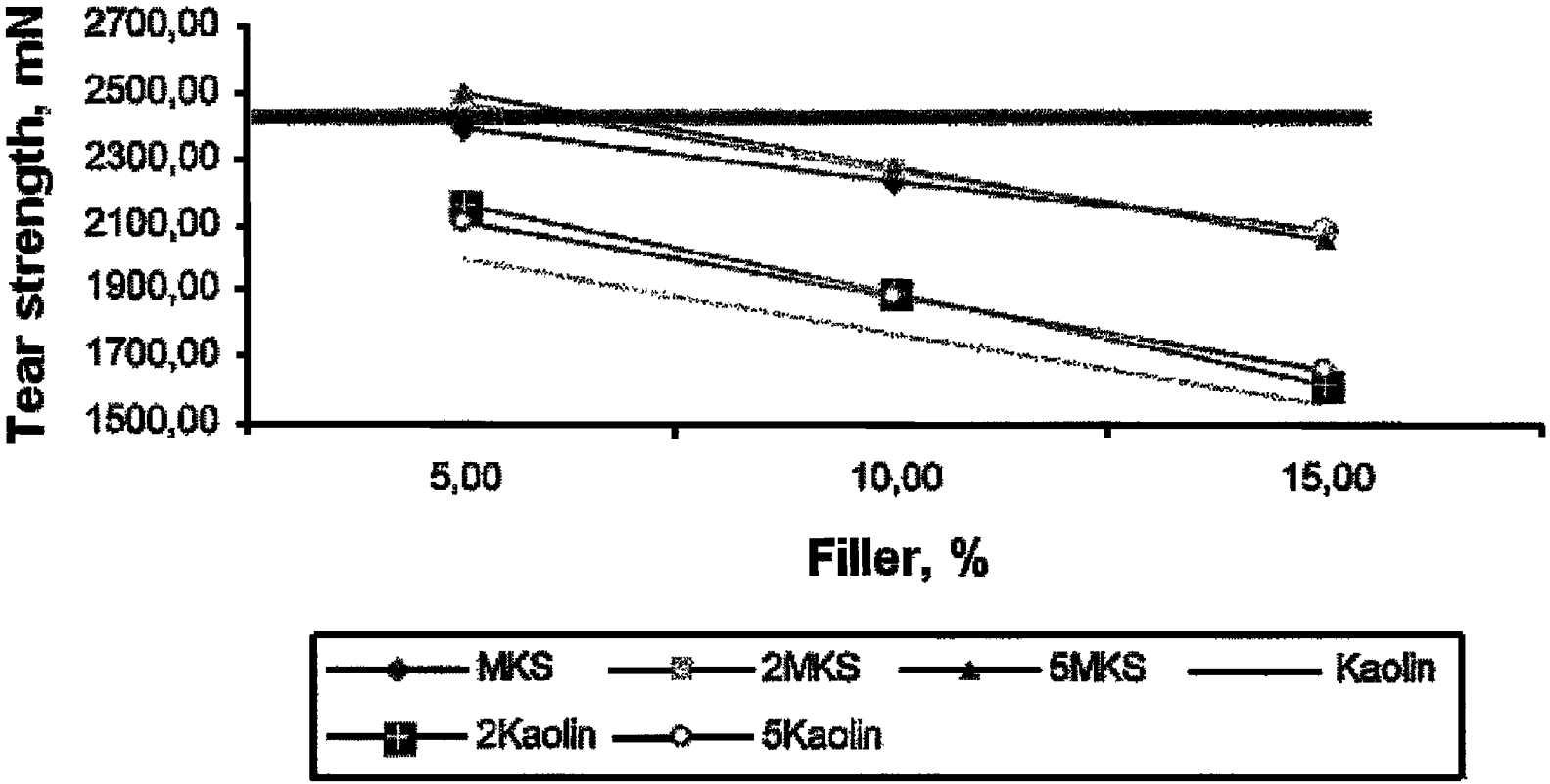
Figure 3A:
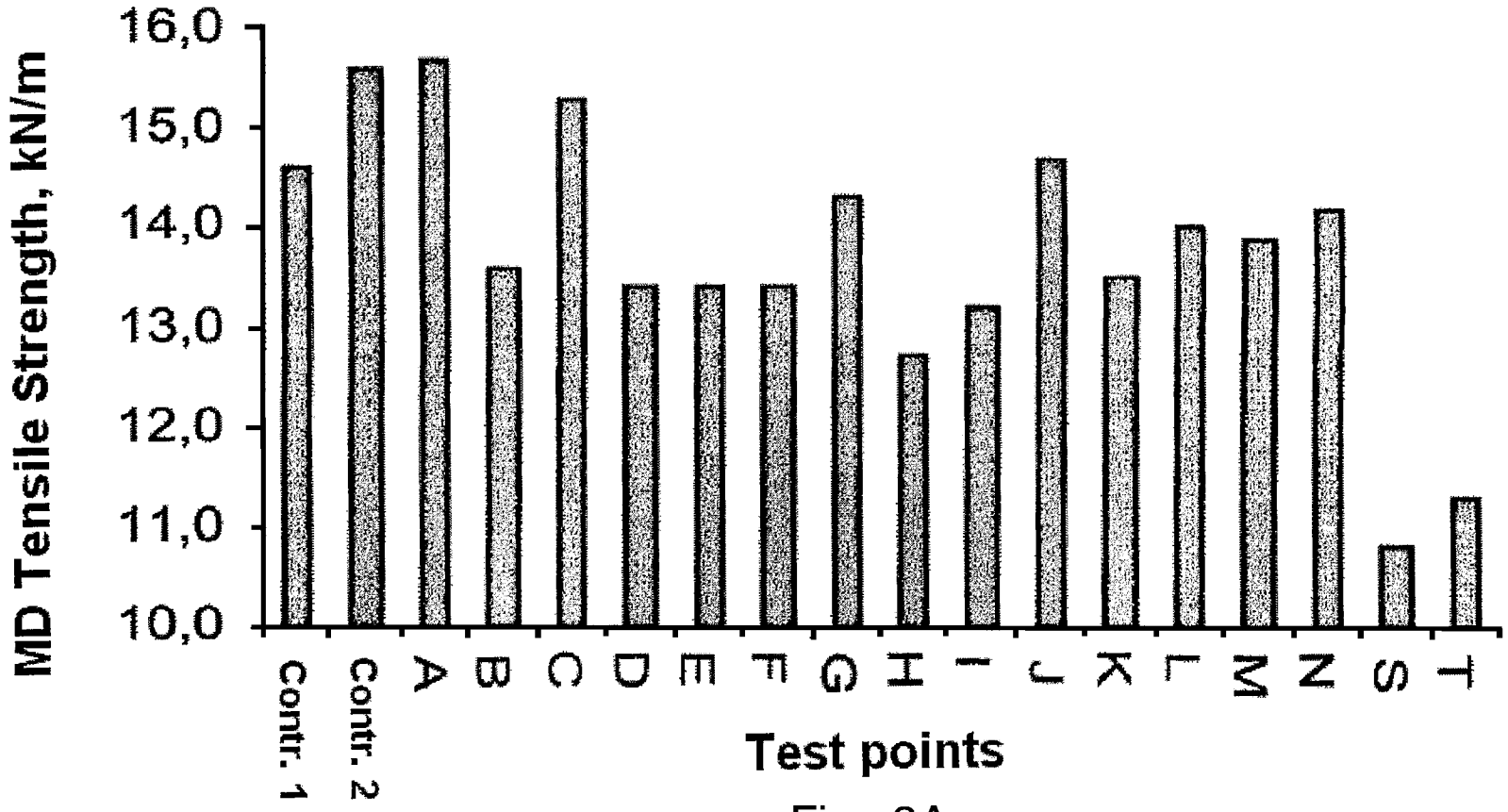
FIGS. 3A-K show graphical comparisons of the properties of different sack papers.
Figure 3B:
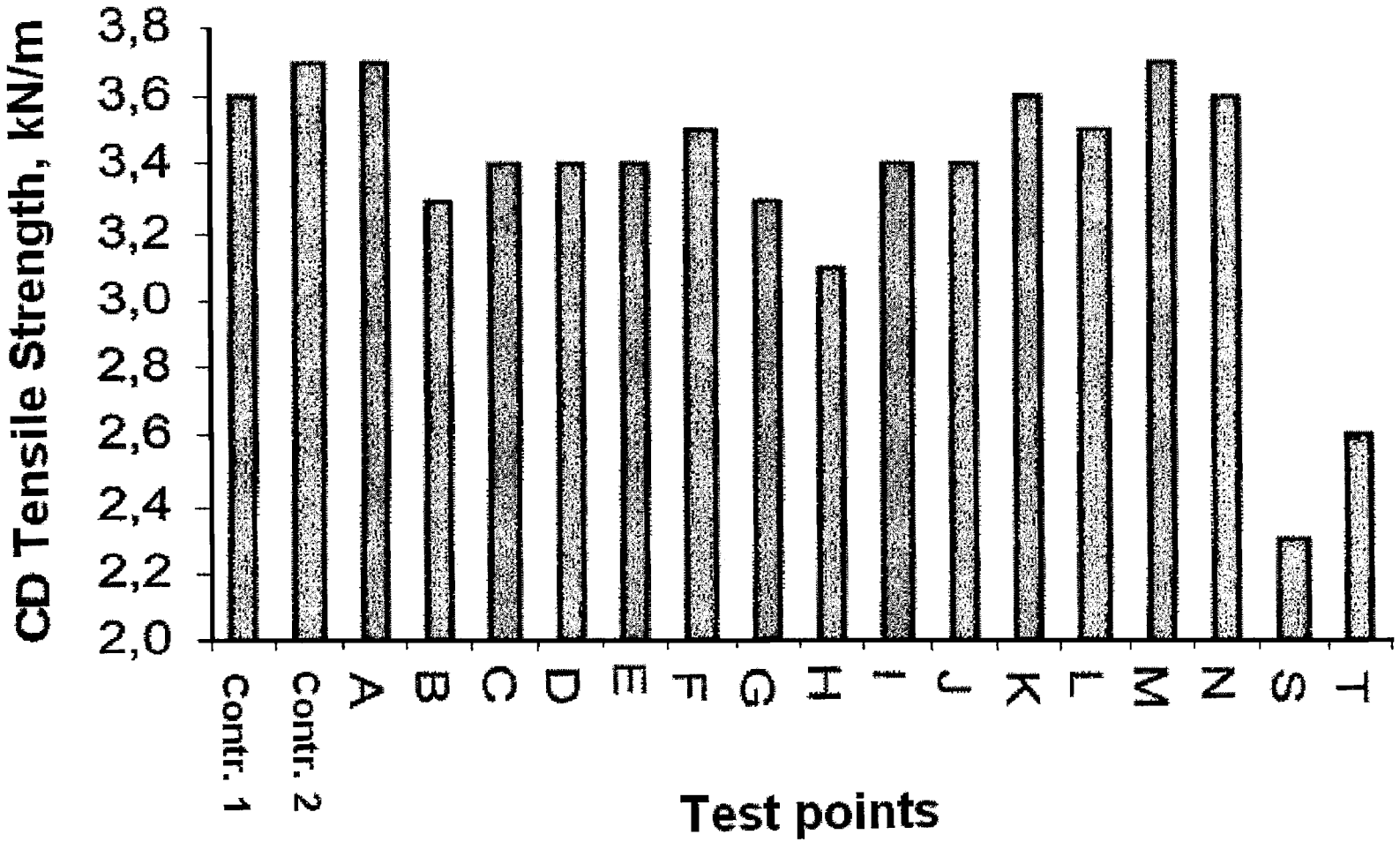
Figure 3C:
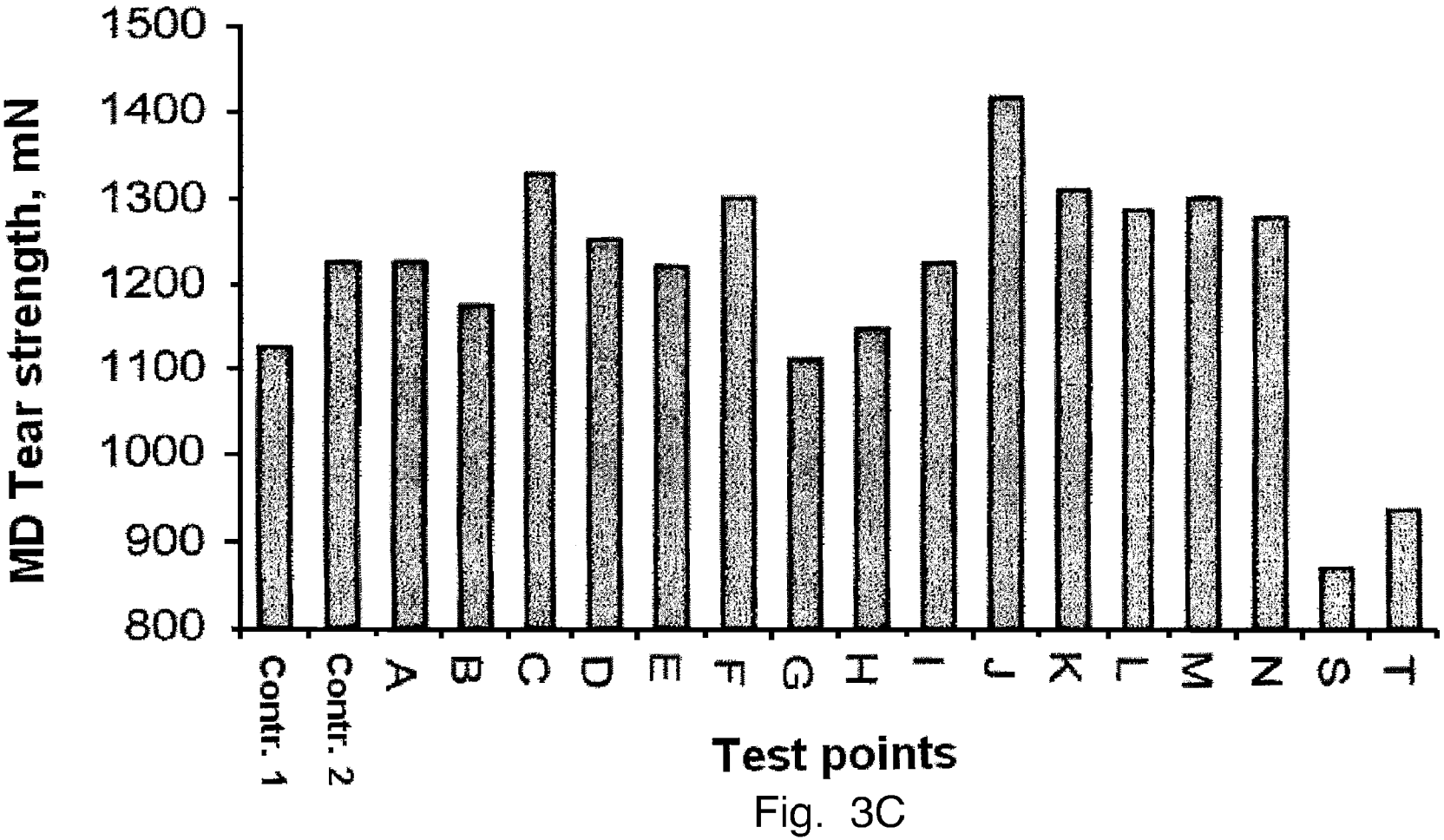
Figure 3D:
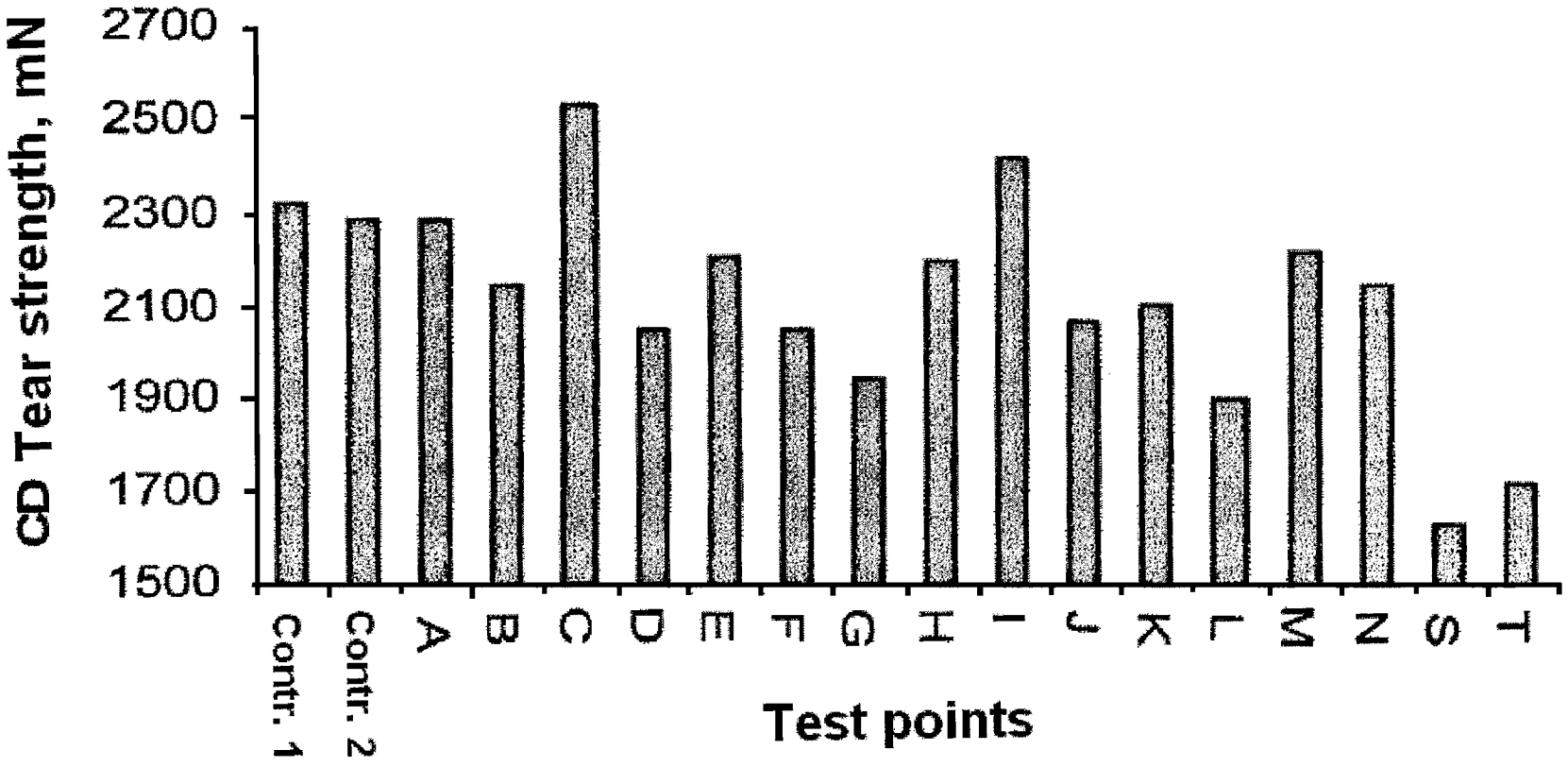
Figure 3E:
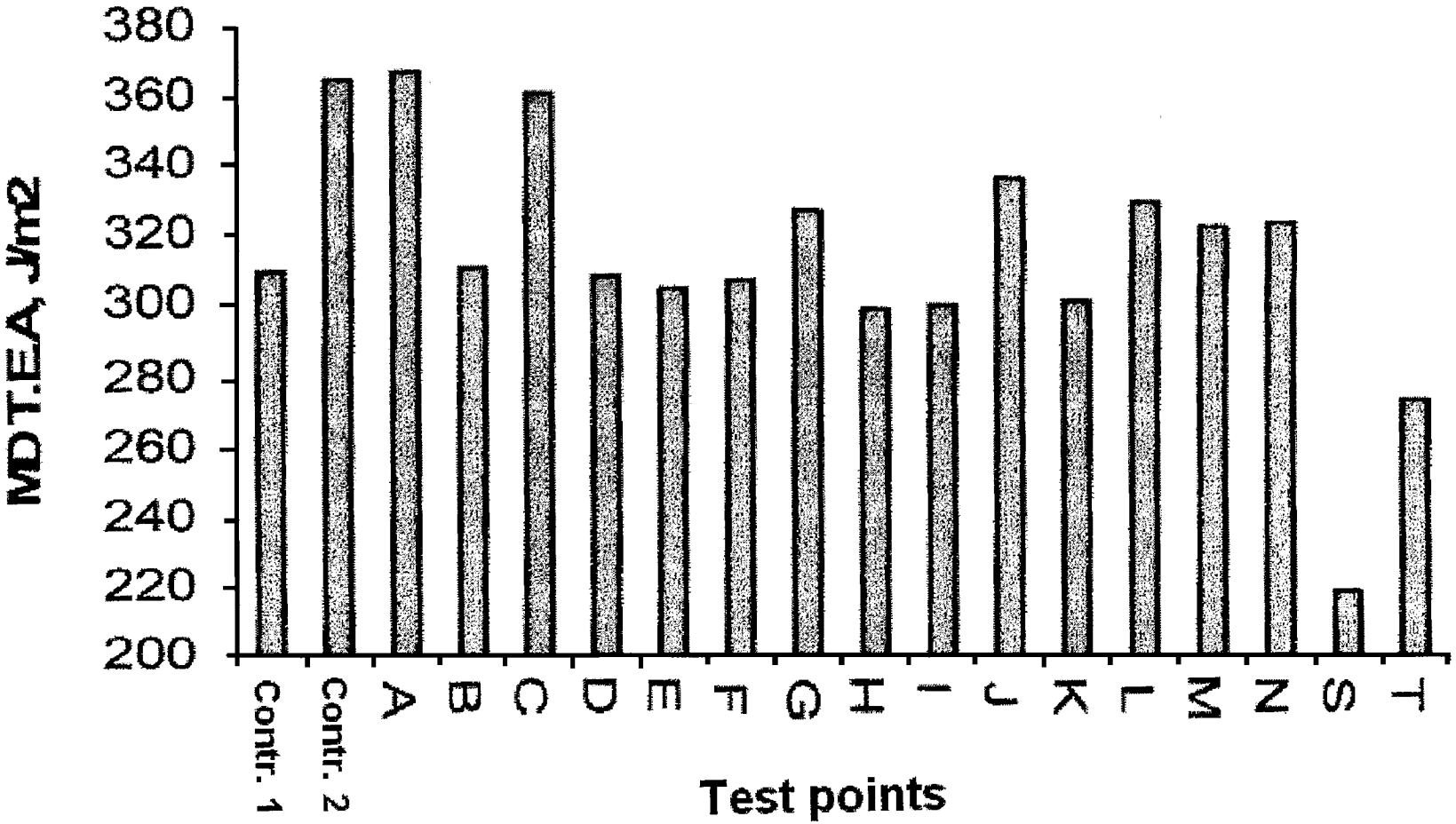
Figure 3F:
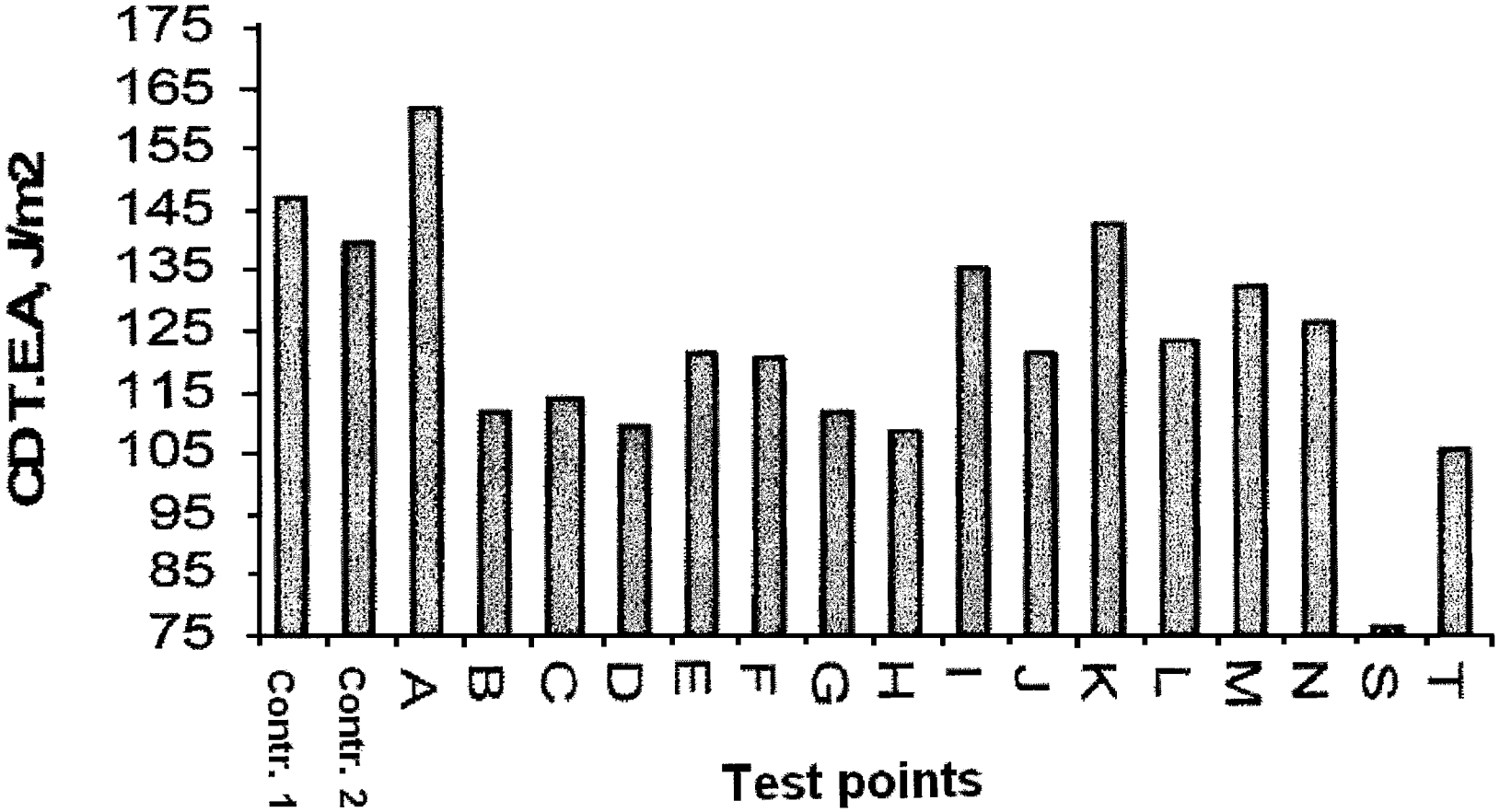
Figure 3G:
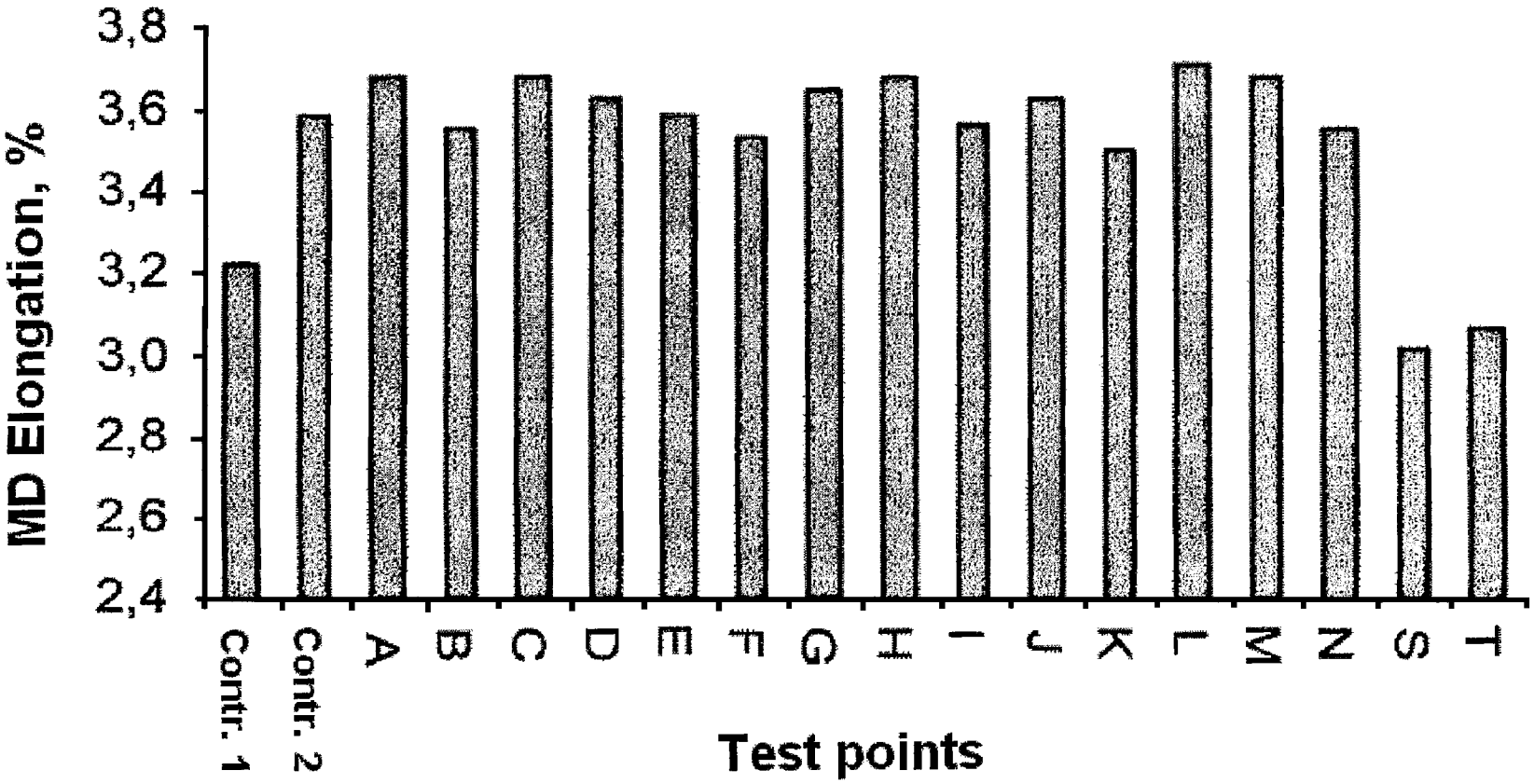
Figure 3H:
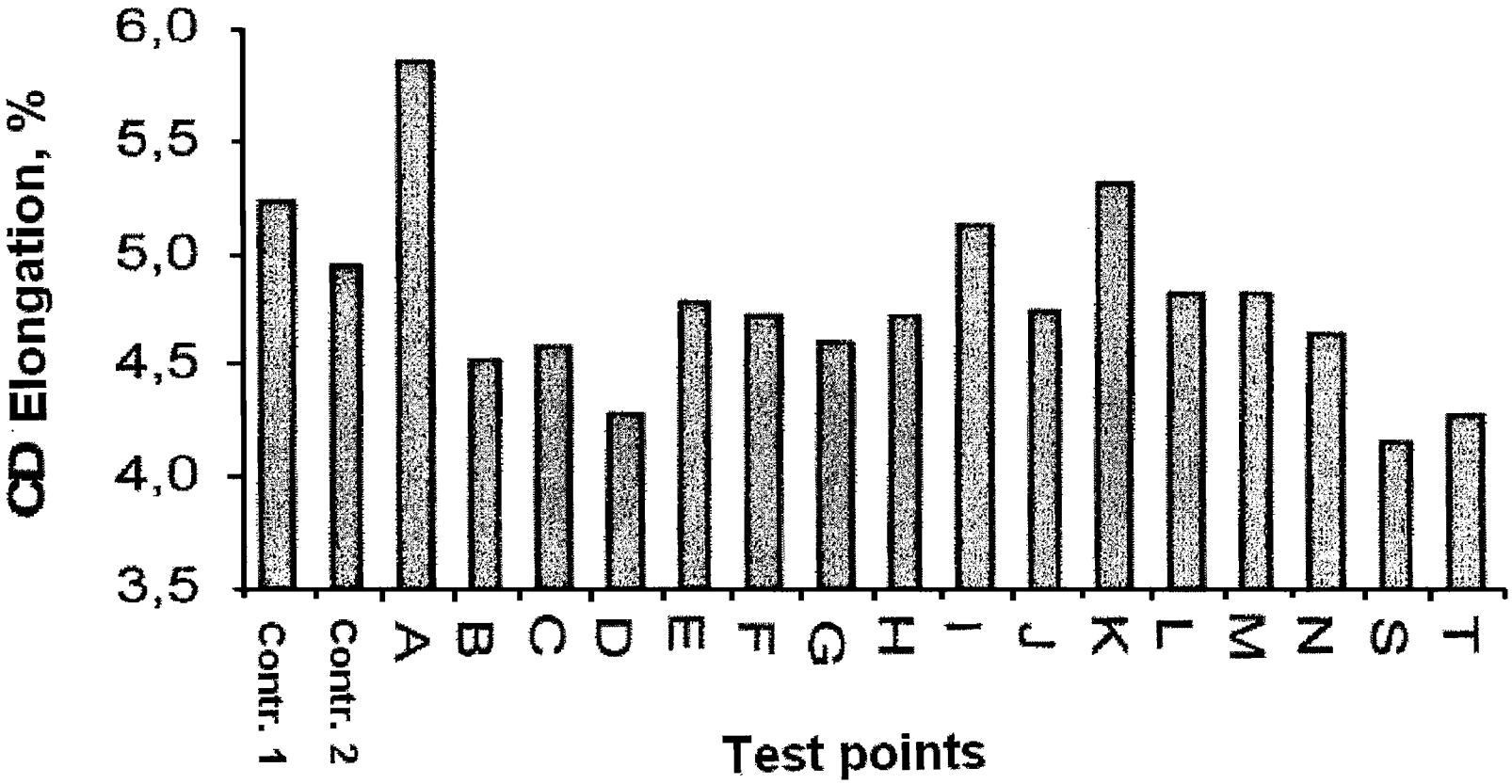
Figure 3I:
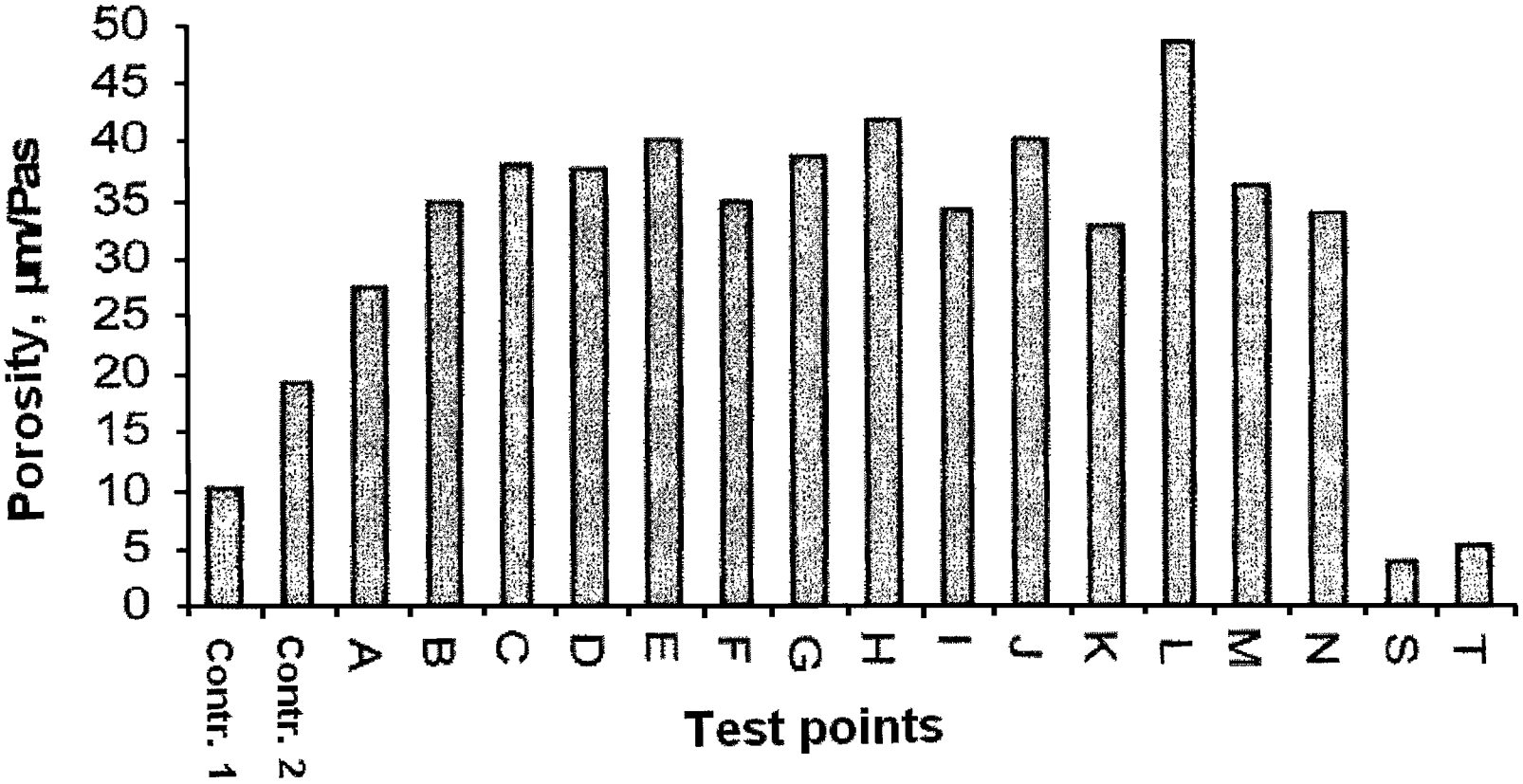
Figure 3J:
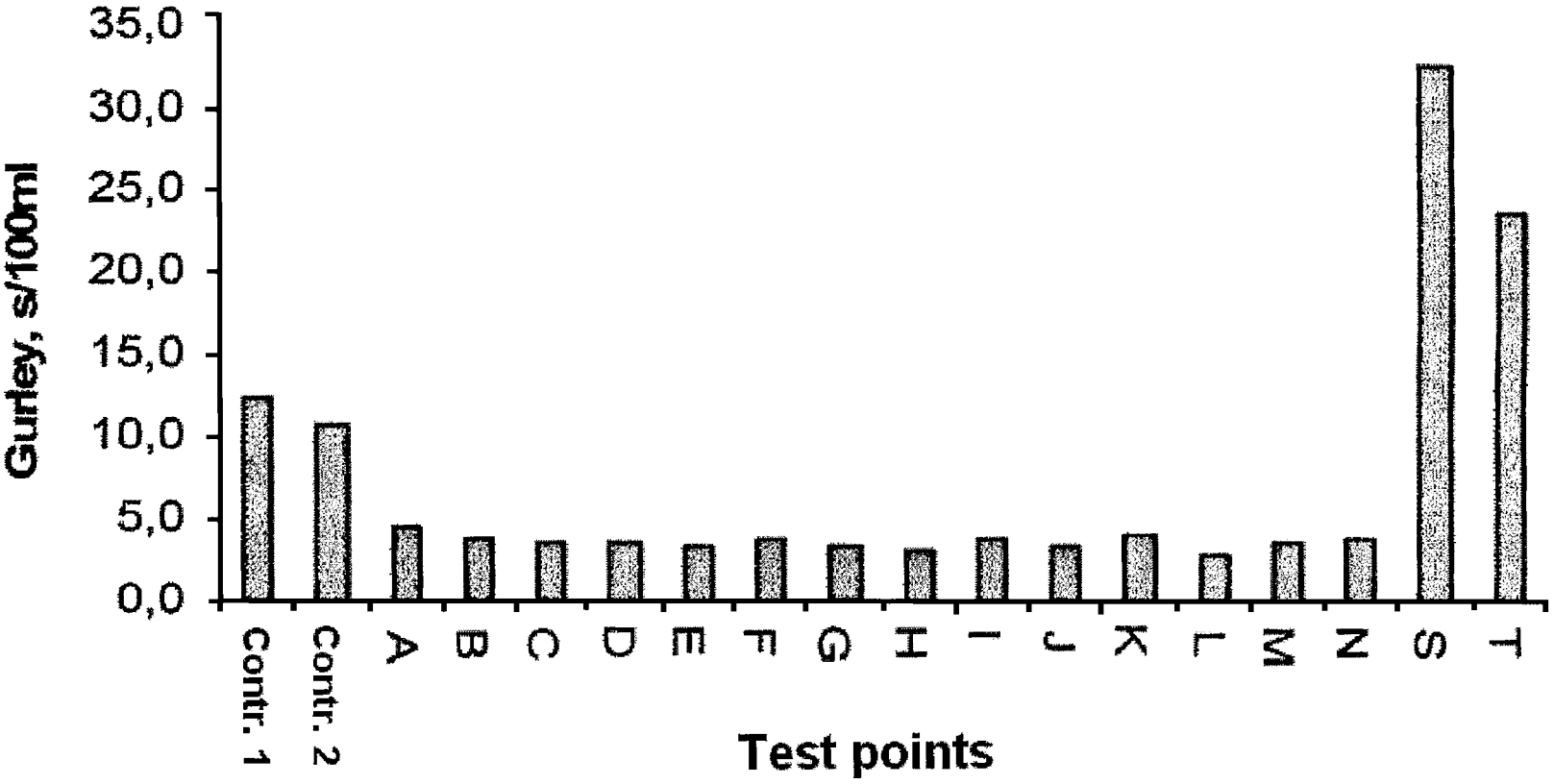
Figure 3K:
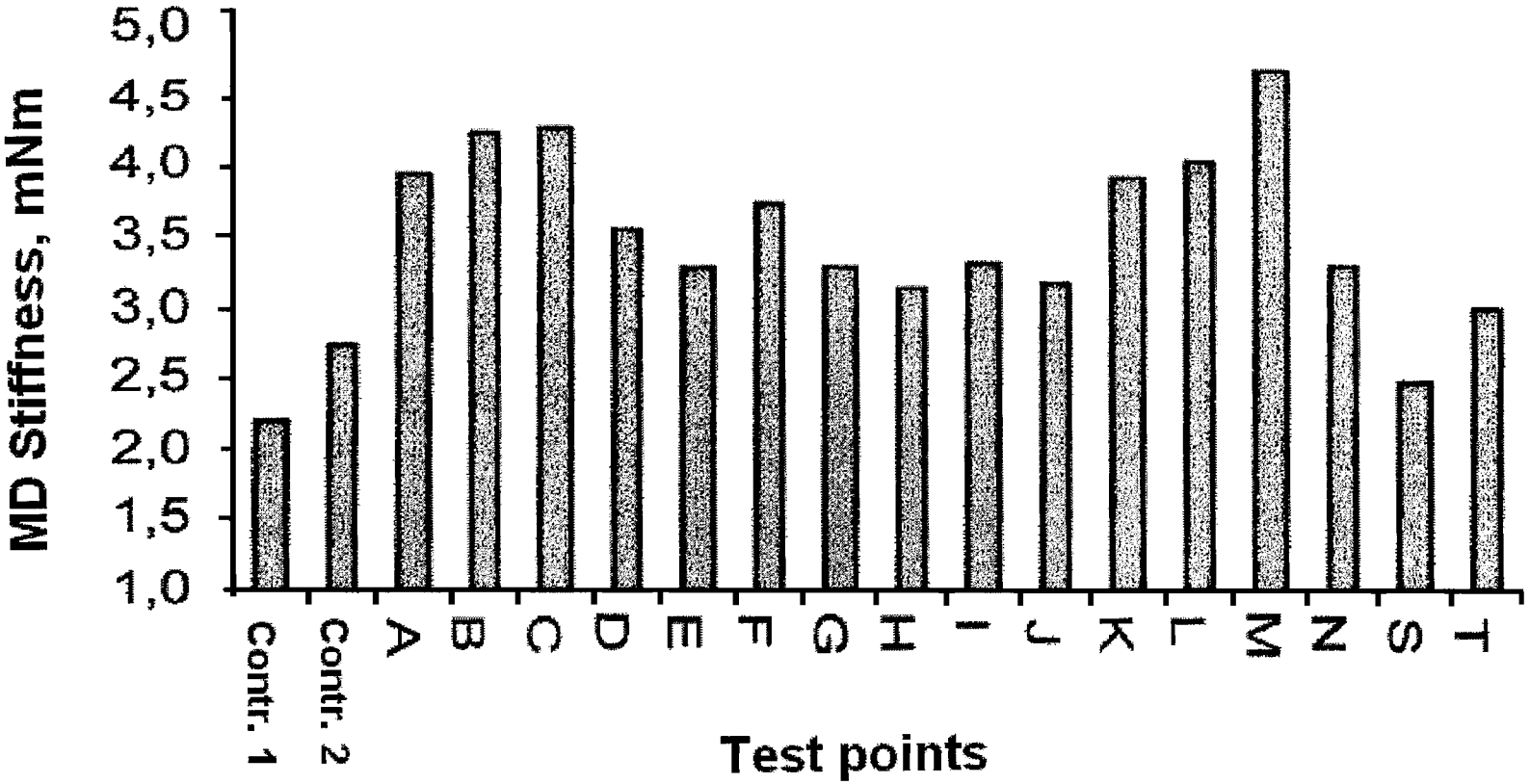

Sack paper sheets were manufactured as in Example 1. The analysis results are shown in Table 2 below, which compares the results of a paper not containing the filler (Control), a paper containing kaolin (Capim DG) as filler, and the filler particles (MKS) that are used according to the invention, whereby in the MKS fraction, different amounts of silicon dioxide are used as binder. The results are also shown in FIGS. 2A and 2B.

TABLE 2

| | MD Tensile strength kN/m | CD Tensile strength kN/m | MD Tear strength mN | CD Tear strength mN | MD T.E.A. J/m$^2$ | CD T.E.A. J/m$^2$ | MD Elongation % | CD Elongation % | Gurley s/100 ml | MD Stiffness mNm |
|---|---|---|---|---|---|---|---|---|---|---|
| Control | 166.50 | 44.80 | 1621.50 | 2428.40 | 382.80 | 178.50 | 3.71 | 5.40 | 9.90 | 2.43 |
| 5% MKS | 143.77 | 33.48 | 1321.63 | 2388.22 | 322.66 | 121.19 | 3.49 | 4.86 | 3.52 | 2.19 |
| 10% MKS | 131.34 | 31.28 | 1256.79 | 2237.51 | 293.90 | 111.08 | 3.41 | 4.69 | 3.28 | 2.11 |
| 15% MKS | 118.92 | 29.08 | 1191.94 | 2086.80 | 265.15 | 100.97 | 3.33 | 4.52 | 3.03 | 2.04 |
| 5% MKS + 2% $SiO_2$ | 152.35 | 35.73 | 1572.89 | 2466.74 | 364.21 | 141.35 | 3.67 | 5.37 | 4.75 | 3.27 |
| 10% MKS + 2% $SiO_2$ | 137.62 | 32.40 | 1437.59 | 2269.67 | 325.65 | 124.21 | 3.52 | 4.97 | 4.30 | 2.96 |
| 15% MKS + 2% $SiO_2$ | 122.89 | 29.07 | 1302.30 | 2072.60 | 287.09 | 107.07 | 3.37 | 4.57 | 3.85 | 2.64 |
| 5% MKS + 5% $SiO_2$ | 147.68 | 35.41 | 1412.16 | 2500.39 | 343.18 | 136.36 | 3.58 | 5.22 | 4.86 | 2.37 |
| 10% MKS + 5% $SiO_2$ | 131.15 | 31.74 | 1301.41 | 2276.31 | 301.71 | 119.49 | 3.40 | 4.88 | 4.33 | 2.26 |
| 15% MKS + 5% $SiO_2$ | 114.61 | 28.07 | 1190.67 | 2052.24 | 260.25 | 102.61 | 3.23 | 4.54 | 3.79 | 2.15 |
| 5% Capim | 134.93 | 31.06 | 1260.35 | 1998.98 | 296.45 | 119.90 | 3.35 | 3.08 | 12.26 | 1.75 |
| 10% Capim | 119.32 | 27.41 | 1122.59 | 1779.22 | 255.24 | 102.91 | 3.08 | 3.04 | 22.16 | 1.59 |
| 15% Capim | 103.71 | 23.77 | 984.84 | 1559.45 | 214.02 | 85.93 | 2.81 | 3.01 | 40.05 | 1.43 |
| 5% Capim + 2% $SiO_2$ | 138.10 | 34.05 | 1241.74 | 2153.97 | 292.49 | 119.84 | 3.54 | 5.21 | 10.66 | 1.44 |
| 10% Capim + 2% $SiO_2$ | 121.47 | 29.92 | 1101.66 | 1887.92 | 250.70 | 102.68 | 3.21 | 4.75 | 16.18 | 1.31 |

TABLE 2-continued

| | MD Tensile strength kN/m | CD Tensile strength kN/m | MD Tear strength mN | CD Tear strength mN | MD T.E.A. J/m$^2$ | CD T.E.A. J/m$^2$ | MD Elongation % | CD Elongation % | Gurley s/100 ml | MD Stiffness mNm |
|---|---|---|---|---|---|---|---|---|---|---|
| 15% Capim + 2% $SiO_2$ | 104.84 | 25.79 | 961.58 | 1621.87 | 208.91 | 85.53 | 2.88 | 4.30 | 35.03 | 1.17 |
| 5% Capim + 5% $SiO_2$ | 138.16 | 31.46 | 1221.62 | 2109.38 | 303.86 | 118.02 | 3.47 | 5.15 | 11.92 | 2.04 |
| 10% Capim + 5% $SiO_2$ | 123.73 | 28.11 | 1098.16 | 1885.54 | 263.75 | 102.87 | 3.16 | 4.80 | 19.23 | 1.81 |
| 15% Capim + 5% $SiO_2$ | 109.30 | 24.76 | 974.70 | 1661.70 | 223.65 | 87.72 | 2.85 | 4.45 | 39.38 | 1.58 |

Example 3

Sack paper sheets were manufactured as in Example 1. The analysis results are shown in Table 3 below, which compares the results of a metakaolin sinter prepared from two different kaolin sources (Kaolin and MKS) and untreated wet-cleaned kaolin (Capim), with and without various chemicals that improve the strength. The results are also shown in FIGS. 3A-3K. The wet-cleaned kaolin used was Capim DG.

The markings in the table and the figures stand for the following:

Control 1 5 kg/tonne of starch (R70021) and high-consistency pulp

Control 2 15 kg/tonne of starch (R70021) and high-consistency pulp

A Kaolin+3% $SiO_2$+1% alum

B MKS+3% $SiO_2$+1% alum

C Kaolin+5% glyoxal

D MKS+5% glyoxal

E Kaolin+3% $SiO_2$

F MKS+3% $SiO_2$

G Kaolin

H MKS

I Kaolin+2% $SiO_2$+5% glyoxal

J MKS+2% $SiO_2$+5% glyoxal

K Kaolin+1% $SiO_2$

L MKS+1% $SiO_2$

M Kaolin+2% $SiO_2$

N MKS+2% $SiO_2$

S Capim

T Capim+5% glyoxal

TABLE 3

| | Control 1 | Control 2 | A | B | C | D | E | F | G |
|---|---|---|---|---|---|---|---|---|---|
| Basis weight, g/m$^2$ | 106.1 | 105.1 | 104.8 | 105.6 | 105.9 | 105.3 | 105.2 | 106.0 | 104.6 |
| Filler, % | 0.8 | 0.9 | 13.3 | 14.1 | 13.6 | 13.9 | 13.6 | 13.7 | 13.8 |
| Porosity, μm/Pas | 10 | 20 | 27 | 35 | 38 | 38 | 40 | 35 | 39 |
| Gurley, s/100 ml | 12.4 | 10.8 | 4.6 | 3.7 | 3.6 | 3.5 | 3.3 | 3.8 | 3.4 |
| MD Tear strength, mN | 1128 | 1227 | 1226 | 1176 | 1330 | 1254 | 1221 | 1301 | 1116 |
| CD Tear strength, mN | 2325 | 2286 | 2286 | 2149 | 2532 | 2050 | 2212 | 2049 | 1945 |
| MD Tensile strength, kN/m | 14.6 | 15.6 | 15.7 | 13.6 | 15.3 | 13.4 | 13.4 | 13.4 | 14.3 |
| CD Tensile strength, kN/m | 3.6 | 3.7 | 3.7 | 3.3 | 3.4 | 3.4 | 3.4 | 3.5 | 3.3 |
| MD T.E.A., J/m$^2$ | 310 | 365 | 367 | 311 | 361 | 308 | 305 | 308 | 327 |
| CD T.E.A., J/m$^2$ | 147 | 140 | 162 | 112 | 114 | 110 | 121 | 121 | 112 |
| MD Elongation, % | 3.2 | 3.6 | 3.7 | 3.6 | 3.7 | 3.6 | 3.6 | 3.5 | 3.7 |
| CD Elongation, % | 5.2 | 5.0 | 5.9 | 4.5 | 4.6 | 4.3 | 4.8 | 4.7 | 4.6 |
| MD Stiffness, mNm | 2.2 | 2.8 | 4.0 | 4.2 | 4.3 | 3.6 | 3.3 | 3.8 | 3.3 |

| | H | I | J | K | L | M | N | S | T |
|---|---|---|---|---|---|---|---|---|---|
| Basis weight, g/m$^2$ | 105.5 | 105.3 | 105.2 | 104.7 | 106.0 | 105.7 | 105.2 | 105.3 | 105.8 |
| Filler, % | 13.5 | 13.5 | 14.2 | 13.6 | 13.8 | 13.6 | 13.9 | 13.7 | 14.0 |
| Porosity, μm/Pas | 42 | 34 | 40 | 33 | 49 | 36 | 34 | 4 | 5 |
| Gurley, s/100 ml | 3.2 | 3.8 | 3.3 | 4.0 | 2.9 | 3.6 | 3.9 | 32.6 | 23.5 |

TABLE 3-continued

| | | | | | | | | | |
|---|---|---|---|---|---|---|---|---|---|
| MD Tear strength, mN | 1148 | 1226 | 1421 | 1312 | 1289 | 1304 | 1282 | 872 | 940 |
| CD Tear strength, mN | 2201 | 2422 | 2072 | 2104 | 1904 | 2218 | 2144 | 1634 | 1718 |
| MD Tensile strength, kN/m | 12.7 | 13.2 | 14.7 | 13.5 | 14.0 | 13.9 | 14.2 | 10.8 | 11.3 |
| CD Tensile strength, kN/m | 3.1 | 3.4 | 3.4 | 3.6 | 3.5 | 3.7 | 3.6 | 2.3 | 2.6 |
| MD T.E.A., $J/m^2$ | 300 | 301 | 337 | 302 | 330 | 322 | 323 | 219 | 274 |
| CD T.E.A., $J/m^2$ | 109 | 136 | 121 | 143 | 124 | 132 | 126 | 77 | 106 |
| MD Elongation, % | 3.7 | 3.6 | 3.6 | 3.5 | 3.7 | 3.7 | 3.6 | 3.02 | 3.07 |
| CD Elongation, % | 4.7 | 5.1 | 4.7 | 5.3 | 4.8 | 4.8 | 4.6 | 4.16 | 4.29 |
| MD Stiffness, mNm | 3.1 | 3.3 | 3.2 | 3.9 | 4.0 | 4.7 | 3.3 | 2.5 | 3.0 |

In other words, as shown by the above examples, the filler agglomerates according to the invention improve the permeability to air of sack paper and the stiffness of the paper. The permeability to air increases to 3-3.5-fold and the stiffness increases to about 1.5-fold. Other properties important to sack paper or similar materials, such as strength, are successfully kept on an advantageous level or even improved. Simultaneously, the amount of chemical pulp fibre of sack paper is reduced by as much as 12-13% by weight.

While the present invention has been illustrated and described with respect to a particular embodiment thereof, it should be appreciated by those of ordinary skill in the art that various modifications to this invention may be made without departing from the spirit and scope of the present.

What is claimed is:

1. A kraft paper product formed into sack paper comprising:

a plurality of fibres, the fibres comprising at least one of chemical pulp or wood;

a plurality of agglomerated filler particles attached between the fibres as structural filler particles in the form of at least partially calcined kaolin agglomerates, the structural filler particles having an essentially spherical shape and a size of 10-40 microns, and a binder both between the fibres and between the fibres and the particles, the binder comprising silicon dioxide, alum, aldehyde or a mixture thereof.

2. The product according to claim 1, wherein the filler particles consist of the agglomerates, granules or sinters of metakaolin.

3. The product according to claim 1, wherein the amount of silicon dioxide in the binder is 0.5-50% by weight.

4. The product according to claim 3, wherein the amount of silicon dioxide in the binder is 0.5-3% by weight.

5. The product according to claim 1, wherein the amount of alum in the binder is 0.5-50% by weight.

6. The product according to claim 5, wherein the amount of alum in the binder is 0.5-3% by weight.

7. The product according to claim 1, wherein the amount of aldehyde in the binder is 0.5-50% by weight.

8. The product according to claim 7, wherein the amount of aldehyde in the binder is 0.5-5% by weight.

9. The product according to claim 1, wherein the silicon dioxide is silicon dioxide micro gel or silicon dioxide sol.

10. The product according to claim 1, wherein the aldehyde is glyoxal.

11. The product according to claim 1, wherein the product contains not more than 25% by weight of filler particles.

12. The product according to claim 1, wherein the filler particles have a size of –20-40 microns.

13. The product according to claim 1, wherein the product is a sack paper product.

14. The product according to claim 1, wherein the product is a paper bag.

15. A method for manufacturing a kraft paper product comprising:

forming an aqueous dispersion comprising a filler in the form of at least partially calcined kaolin agglomerates;

mixing the aqueous dispersion with a binder comprising at least one of silicon dioxide, alum or aldehyde;

producing filler drops from the aqueous dispersion in a spray dryer;

forming filler particles having a size of 10-40 microns are formed by evaporation of excess water from the filler drops;

attaching the formed filler particles to a plurality of fibres dispersed in water, the fibres comprising at least one of chemical pulp or wood; and forming sack paper from the dispersion.

16. The method according to claim 15, further comprising the step of adding an acidic chemical to the aqueous dispersion after adding the binder.

17. The method according to claim 16, wherein the acidic chemical is one of an acid, an aluminium sulphate and a chemical having a sulphate group.

* * * * *